United States Patent [19]

Kudra, III

[11] 4,230,202

[45] Oct. 28, 1980

[54] ROOFING AID

[76] Inventor: Anthony J. Kudra, III, 4837 Farley, Kansas City, Mo. 64129

[21] Appl. No.: 40,193

[22] Filed: May 18, 1979

[51] Int. Cl.[2] ..... E06C 7/08; E06C 1/04; E06C 7/46

[52] U.S. Cl. ..... 182/45; 182/194; 182/219; 5/481

[58] Field of Search ..... 182/45, 46, 230, 194, 182/196, 219; 5/481, 448, 474

[56] References Cited

U.S. PATENT DOCUMENTS

| | | | |
|---|---|---|---|
| 1,196,667 | 8/1916 | Dallmeyer | 182/194 |
| 2,518,107 | 8/1950 | Wilson | 182/194 |
| 2,552,476 | 5/1951 | Barton | 5/448 |
| 2,708,543 | 5/1955 | Matich | 182/45 |
| 3,337,884 | 8/1967 | Meier | 5/481 |

FOREIGN PATENT DOCUMENTS

| | | | |
|---|---|---|---|
| 2388124 | 12/1978 | France | 182/45 |
| 1145276 | 3/1969 | United Kingdom | 182/45 |

*Primary Examiner*—Reinaldo P. Machado
*Attorney, Agent, or Firm*—Scofield, Thomas M.

[57] ABSTRACT

Improvements in roofing ladders and work platforms; anti-skid devices for aiding seating and movement of a roofing worker on and over the (typically) inclined roof surface being worked; anti-skid seats, platforms and ladders for roofing work.

18 Claims, 11 Drawing Figures

Fig. 5.
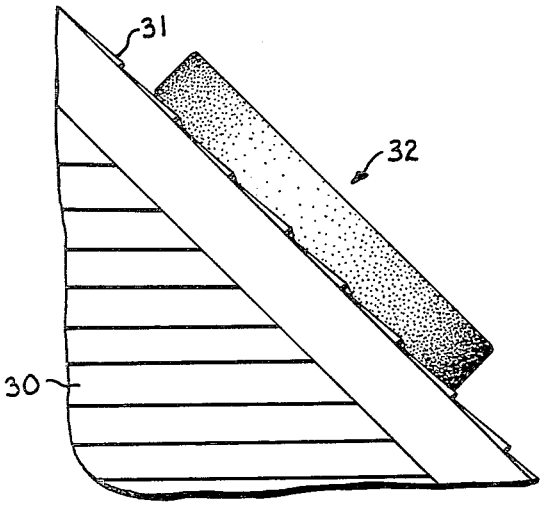
Fig. 6.
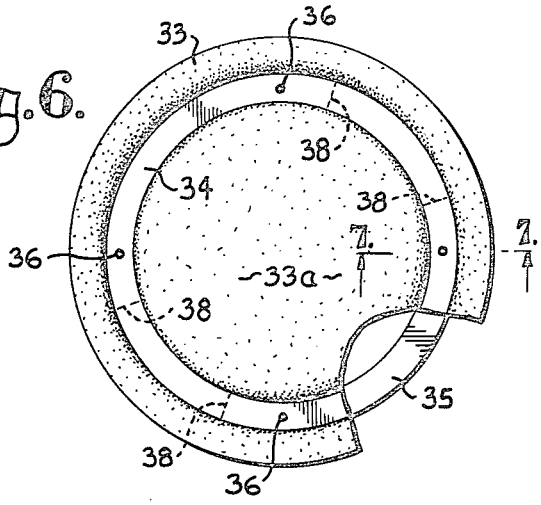
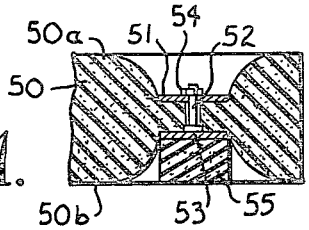
Fig. 11.
Fig. 8.
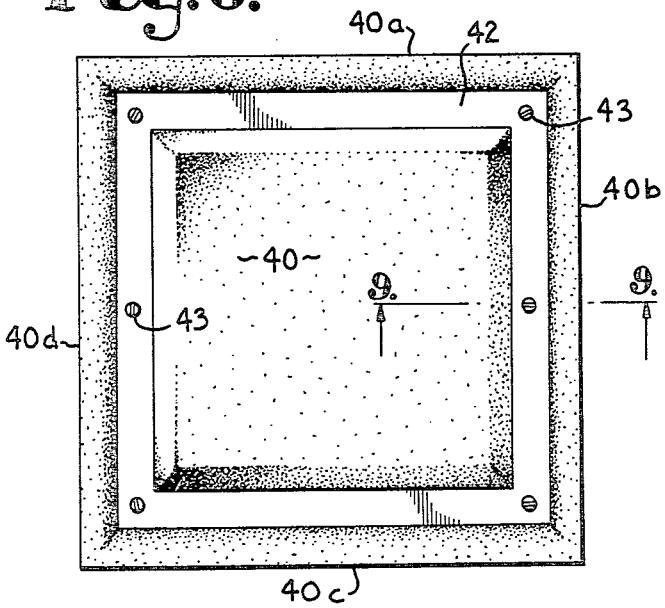
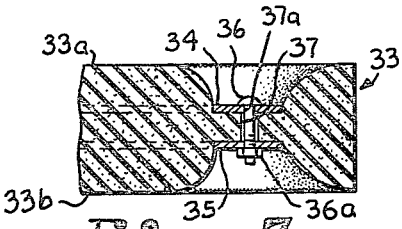
Fig. 7.
Fig. 10.
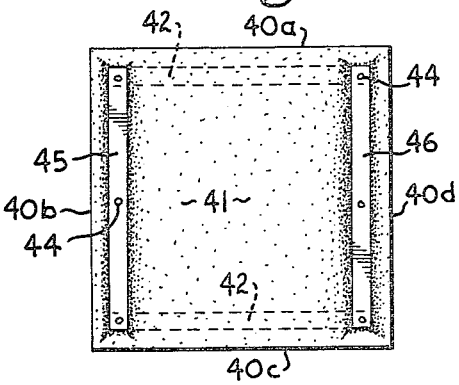
Fig. 9.
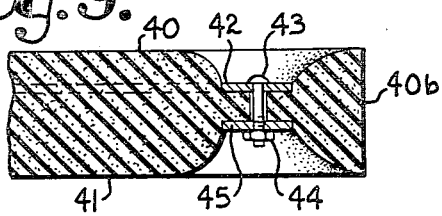

ROOFING AID

BACKGROUND OF THE INVENTION

In the construction, repair and maintenance of houses and homes, much roofing work must be done. In addition to basic roofing, painters and workers with antennae, vents and the like must work on and traverse roofs to varying degrees and for varying intervals of time. Typically, however, roofers, per se must spend the largest amount of time and effort on the roof incline and thus must deal with problems of securing themselves and their work on the portion of the roof currently being worked and moving about with respect thereto. This device is particularly designed for use with and by experienced roofers, but may advantageously be employed in their tasks by accessory roof workers such as those noted previously.

One class of roofing work having particular problems involves asphalt shingling and particularly such in the heat of the day. Thus, in the interval noted, most roofers leave off work because of heat problems with respect to the shingling heat absorption, as well as the problems of making scar marks in the tar in working in the heat. The heat absorbed by an asphalt roof can burn a roofer or, at the very least, be extremely uncomfortable. Such time limitations severely limits the amount of useful work which can be done on asphalt roofs in the hot seasons of the year.

Roofing work is measured by "squares", which are 100 foot squares. Each square takes three to four bundles of shingles, each bundle having twenty-four to twenty-eight shingles. Typically, a worker may plan on completing seven squares a day in hot weather. The subject invention markedly increases the number of squares which may be roofed.

As well be seen below from the delineation of the prior art patents, roofing ladders and devices are known to the art. The expense, complexity, cumbersomeness and time required to apply, move and remove these devices are all objectionable. Additionally, certain of them damage the roofs themselves. Improved means are needed and required which can be readily applied to and removed from the roof, moved about thereon and which provide security both with respect to holding on the roof and insulation with respect to roofing heat. Convenience, speed, safety, long life, lightness in weight and the like are clearly desirable goals and purposes of such devices.

THE PRIOR ART

Applicant is aware of the following patents directed to roofing ladders, platforms and securements:

Austin U.S. Pat. No. 524,661 "Roofing Ladder", issued Aug. 14, 1894;

Austin U.S. Pat. No. 505,343 "Adjustable Pitch Roof Ladder", issued Sept. 19, 1893;

Campion U.S. Pat. No. 2,476,401 "Pitch Roof Platform", issued July 19, 1949; and Raitt U.S. Pat. No. 2,781,158 "Ladders", issued Feb. 12, 1957.

Applicant is further aware of the following patents directed to ladder shielding, coating and anti-skid or slip means:

Johnson U.S. Pat. No. 2,138,171 "Anti-Slip Device", issued Nov. 29, 1938;

Webson U.S. Pat. No. 2,518,107 "Shin shield For Step Ladders", issued Aug. 8, 1950; and Arnold U.S. Pat. No. 2,855,134 "Metal Ladder", issued Oct. 7, 1958.

BRIEF DESCRIPTION OF THE INVENTION

The subject device basically comprises a pad or cushion of surface adhering material such as foam rubber or foam plastic and an accompanying, engaging frame structure which operates to rigidify the pad and retain its shape under load, while causing major portions of the pad to protrude or extend with respect to the frame for roof engaging purposes.

There are basically two modifications of the subject invention. A first form or variation involves a relatively small area cushion or pad of circular, oval, square or rectangular form which is primarily usable as a seat by the roofer or roofing worker and is readily and easily movable about the roof. The second form or modification involves an elongate ladder-like structure of greater or lesser length, depending upon the specific use or purpose, which is designed for larger area use and work on the roof. The latter device may be used in either vertical (up and down the roof) or horizontal (laterally across the roof) application, as required by the nature of the work.

OBJECTS OF THE INVENTION

A first object of the subject invention is to provide improved roofing or roof working aids readily usable by and adaptable to aid the activities of all types of roof workers, including roofers, per se, painters, and antennae, vent and chimney workers, as well as roofing and gutter clearers and cleaners.

Another object of the invention is to provide a novel device adapted to be placed on horizontal or inclined roofs (inclinations up to approximately 50°, typically) which will removably adhere to the roof when weight is placed thereon and aid and secure work being done on the roof's structure and surface.

Another object of the invention is to provide roofing work aid devices which are not nailed or secured to the roof structure, need not be hung from the ridge and which, in use, do not penetrate or damage any of the roofing structure, yet provide a useful, safe and secure place, location and surface upon which a roofer may sit or kneel while performing his work, thereby being aided in maintaining and securing his position and location on the roof.

Another object of the invention is to provide a relatively inexpensive yet strong, weather resistant and long lived device which will substantially aid a roofing worker in performing and carrying out varied tasks in a dependable manner.

Another object of the invention is to provide a multiplicity of forms of roofing work aiding device, which various forms will provide a most versatile approach to the universal problems of roofing workers, particularly including problems of those who must work with and on asphalt roofs.

Another object of the invention is to provide such devices wherein all of the parts of the device are readily available for inspection, maintenance, cleaning, repair and replacement, the device having a long, dependable life under hard use in regular roof working conditions.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are used to indicate like parts.

FIG. 5 is a side view of an inclined roof (a portion thereof) with the second form, modification or variation of the device seen in FIGS. 6 and 7 shown mounted thereon. The inclination of the roof of FIG. 5 is just about the maximum inclination upon which any of the subject devices would be used (40° to 50°).

FIG. 6 is a vertical plan view of a second form, variation or modification of the subject device, here shown circular in form, a portion of the device cut away to better illustrate its construction.

FIG. 7 is a view taken along the line 7—7 of FIG. 6 in the direction of the arrows.

FIG. 8 is a third form, modification or variation of the subject device, considerably like that seen in FIGS. 5–7, inclusive, but square in form, rather than circular or oval. FIG. 8 is a vertical plan view of the device, from above, looking down toward the roof working surface upon which the device would rest.

FIG. 9 is a view taken along the lines of 9—9 of FIG. 8 in the direction of the arrows.

FIG. 10 is a view of the underside of the device of FIGS. 8 and 9.

FIGS. 1-4, INCLUSIVE

Figure 1:
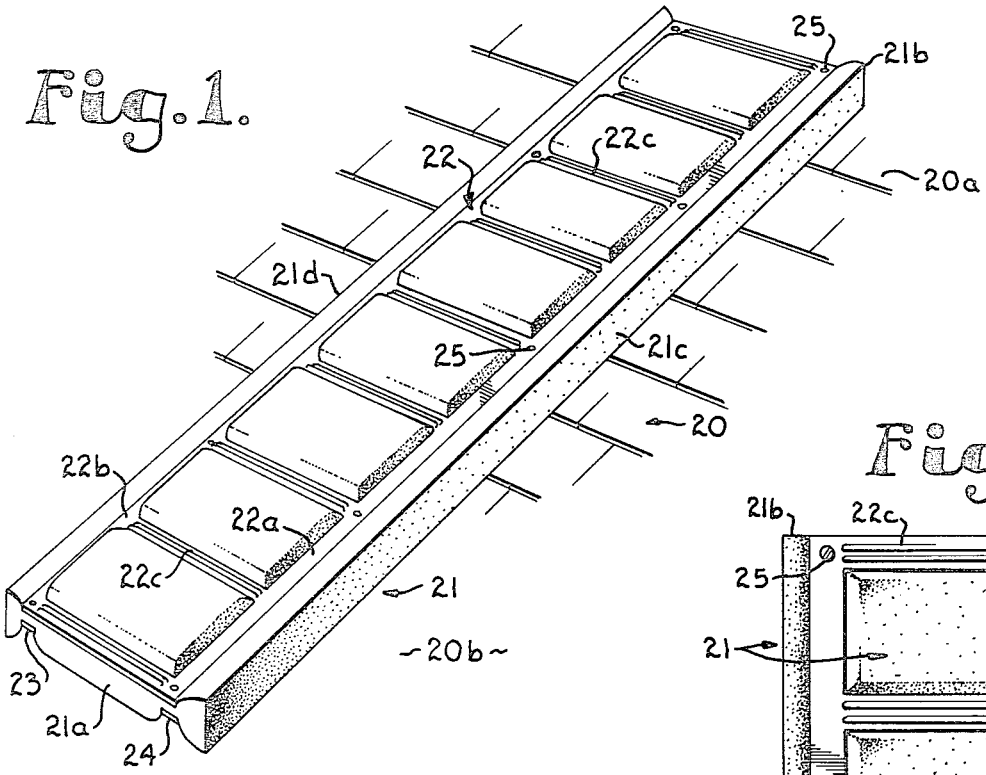
FIG. 1 is a three quarter perspective view, from above, of a first (longer) form or variation of the subject invention in place on an inclined roof (in the illustration shown, positioned vertically (running up and down the roof)).
Figure 2:
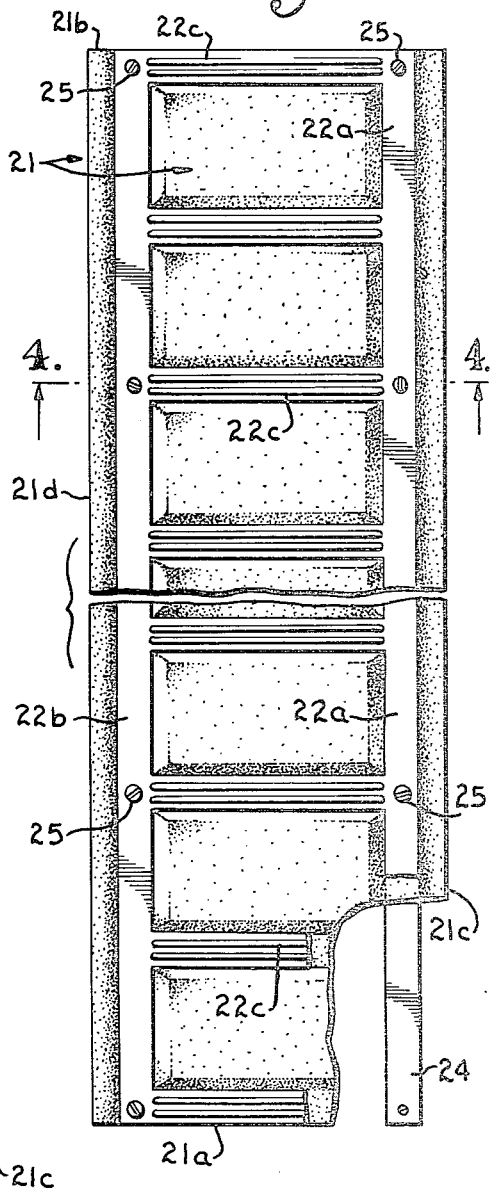
FIG. 2 is a vertical plan view, from above, of the roofing device of FIG. 1, portions of the device cut away to better illustrate the construction thereof.
Figure 3:
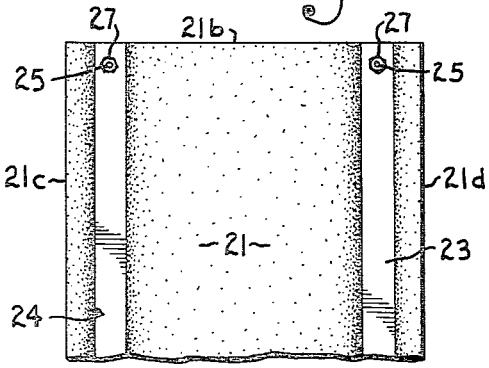
FIG. 3 is a fragmentary plan view of the underside of the device of FIGS. 1 and 2, taken at the top of the device in the views of FIGS. 1 and 2.

Within FIGS. 1–4, inclusive, there is seen a first, and preferred, form of roofing aid incorporating the present invention. This device, to be described, is to be used on roofs, in roofing work and is usable for all the various purposes of major and minor roofing work for which workmen go onto the roof itself. The device of FIG. 1 and 2 may be used in a position extending essentially normal to the ridge line, such essentially parallel thereto or at some angle therebetween. This depends upon the configuration of the roof and the type or purpose of the work of the roofer or the roofing worker.

The basic device of these figures has three elements, which will be first described in one very useable or optimum form (the elements thereof and their joinder) and then such variations in such basic form as may be employed without transitioning to the minimum size devices of FIGS. 5–10, inclusive. In all forms of all figures, there are basically two elements:

(1) A cushion or pad of resilient, deformable yet shape retaining material which is surface adherent to roofing materials such as wood, asphalt shingles and the like. Typical such materials include, as a first choice, foam rubber and, secondly, those foam plastics which have the characteristics described, particularly surface adherence. The purpose of the pad, no matter what form of device is being employed, is to provide a frictionally engaging rest on the roofing platform or surface where the weight of the worker, sometimes transmitted through the worker's knees, buttocks, hands and knees, or even feet, is transmitted to the roof surface through the pad, compressing the pad onto the (typically) inclined roof surface. The vector of force or thrust vertically downwardly through the pad against the inclined roof surface, as the inclination increases, tends to slide or move the pad downwardly on the roof. The surface adherent character the pad is necessary to combat this. Limitation of use of the device to use on less steep roofs (under 45°–50° inclination) is also important.

As previously mentioned, the typical maximum roof inclination on which the device of this may be employed, any form thereof, is around 50°. On roof inclinations thereover, supports either must be nailed to the roof construction itself or suspensions made from the ridge, as in the manner of some of the prior art devices.

An additional purpose of the pade is heat insulation, specifically, to protect the mentioned parts of the roof worker from high heat, such as might be accumulated by asphalt shingling under a hot summer sun. Yet another purpose in some degree of cushioning and comfort with respect to the worker's knees, buttocks, sides (if he should lie on the device) and the like.

(2) In order that the resilient pad or cushion or compressible yet shaped retaining material, with surface adherency, be strong enough, stable enough, versatile enough and broadly useful on the roof, it is necessary to provide a frame which will enable the worker to use the device as if it were, in effect, a ladder or ladder-like device on the roof. Specifically, when the device is laid up and down the roof essentially or substantially normal to the ridge, the equivalent of steps up the length of the device are extremely desirable. Longitudinal stiffening and strengthening of the pad and steps are also necessary or desirable. However, in achieving this effect, the basic criteria of success for the device, specifically, continuous, dependable, large area, frictional surface adherence of the pad underside to the roof, cannot be prevented or minimized, without losing safety.

Accordingly, in my invention, I have provided the desired ladder-like climbing or locating grid structure on the device's upper side, with its rigidity and strength, as well as sure and safe adherence thereof to the pad, without losing the broadest roof contact area of the underside of the pad both centrally and peripherally thereof. The manner in which this is done is now described.

Referring to FIG. 1, at 20 is generally designated a relatively mildly sloped roof having an upper portion 20*a* and a lower portion (away from the ridge) 20*b*. The device in question is made up of a sponge rubber or sponge plastic pad or sheet generally designated 21, a ladder-like upper frame member generally designated 22 and separate (2) second frame means on the other side of the pad from the ladder-like frame member 22 generally designated, respectively, 23 and 24.

To give some idea of the scale of the particular device illustrated in FIGS. 1–4, inclusive, the foam rubber pad 21 is eight feet long, two feet wide and four inches thick. In the views, this pad has lower end 21*a*, upper end 21*b* and elongate parallel side edges 21*c* and 21*d*. The ladderlike upper frame member 22 has elongate side beams 22*a* and 22*b* substantially eight feet in length, there being nine transverse members integrally connecting same designated all 22c, with the end transverse members joining the ends of the side beams 22a and 22b.

Figure 4:
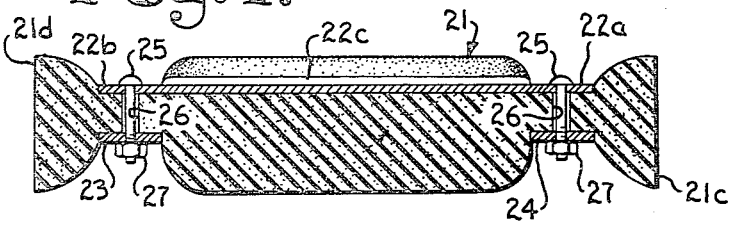
FIG. 4 is a view taken along the lines 4—4 of FIG. 2 in the direction of the arrows.

The longitudinal beam of the first frame member 22 may be one to three inches in width, as may be the transverse members 22c. Members 22c may be corrugated or ridged as shown. The elongate strips or beams 23 and 24 (best seen in FIG. 3) are preferably of identical width to the width of members 22a and 22b and also preferably the same length thereas. A plurality of simple round headed bolts 25 extend through openings (not numbered) spaced along the lengths of beams 22a and 22b, as well as 23 and 24, opposed therein, as well as openings or passages 26 formed through the foam rubber pad as seen in FIG. 4. Nuts 27 threadably engage the threaded ends of bolts 25 whereby to engage the first frame member on the normally upper side of the combination or assembly with the second frame means 23 and 24 on the normally lower side of the assembly.

When nuts 27 are tightened down on bolts 26 (which, incidentally are not of equal length to the thickness of the pads, but, instead, considerably less than such), the first or upper frame member, in its entirety and the second frame means on the other, normally lower side of the pad are deeply impressed or driven into the resilient, foam rubber pad. Because of the greater amount of structure on the upper side of the pad, as well as its grid character, the upward thrust of the free portions of the pad, particularly interior of the ladder grid openings, is considerably less than the downward extension of the pad around beams 23 and 24. The threading on the bolts 25, as well as the length of the bolts themselves, depend on how greatly the frame members are to be compressed into the pad. This may vary according to the density or resiliency of the material, with a greater density material having less impression and the lesser density and higher resilience material more impression. If the pad is of relatively greater density, the threaded ends of the bolts may be oriented upwardly, for minimum roof contact.

Thus, it may be seen that what has been provided is a ladderlike grid or framework, constituting an integral frame member, which overlies the upper side of the pad and is gripped or forced thereinto to a certain extent. Thus this frame, made of spring steel, aluminum or strong plastic, imparts a structure and rigidity to the whole pad.

Variations may be noted. Thus, the upper and lower ends of the pad may extend past the upper and lower extremities of the greater frame member 22 substantially the same distance as the side extension of the pad. Yet further, if desired, the transverse members 22c, or some of them may be extended laterally to the lateral extension of the pad sides to aid in maximizing the downward protrusion or extension of the pad for engagement with a roof surface. These variations are not shown.

It should also be understood that dimensions may vary. Thus, the subject device, with its basic structure, may be formed of as few as three transverse members engaging the side members of the upper frame member, thus giving two upward pads and a rigid, integral structure, with which to work. Any other sub-length of the device seen in FIG. 1 additionally would be workable, having four, six, eight or even more transverse members with respect to the basic upper side ladderlike frame. It should be understood that the basic frame member 22 is preferably, including its transverse members 22c, flat. Variations in the size are not significant as, for example, the lateral extension of the pad beyond the gripping members 22a, 22b, 23 and 24 may be increased or decreased as desired. The area enclosed between the elongate side members 22a and 22b and transverse members 22c may be varied to a certain degree. The thickness of the pad, its density and the material may be varied somewhat. The width of the longitudinal and transverse members on the upper side and longitudinal members on the lower side may vary somewhat.

What is desired is a closed grid-like frame on the upper side of a resilient pad of surface adherent material, with reinforcing structures on the underside which not only grip the pad to the overall frame, but improve the structural integrity. However, the lower frame members must be relieved therebetween to provide the large, elongate, broad surface of frictional engagement between the pad and the roof.

FIGS. 5–7, INCLUSIVE

FIGS. 5–7, inclusive show an extremely simple, relatively small size device analogous to the larger scale device previously described. Referring to FIG. 5, therein is seen the upper end thereof. The angle of inclination of roof 31 with respect to the vertical is 45° to 50°, about the maximum inclination where the subject device can be safely used, including all forms being described in this specification.

Generally designated 32 is the simplified device in question, which has three parts. The first part is a circular or oval pad 33 of resilient, shape retaining, surface adherent material such as a foam rubber or foam plastic pad from two to four inches in thickness and two to four feet in diameter, typically three feet in diameter. In one form of the invention, there is merely provided a pair of flat circular rings 34 and 35 of equal and congruent shape, made of similar materials, such as strong plastic, wood or metal. These rings are from one to three inches in width and of an outer diameter (say for a three foot diameter circular pad) of from two feet to two feet six inches. A plurality of round headed bolts 36 are provided at spaced intervals along the length of rings 34 and 35 and engage same through openings as at 37 in pad 33 and 37a in the rings. Where ring 34 and 35 are both complete circles and of equal width and thickness, they strike equally into the face of the pad and bolts 36 are of less length than the pad thickness (say two to two and half inches for a four inch thick pad). Limits on thread lengths on bolt shafts in all forms may limit stike of beams and rings into the pads.

The pad upper and lower sides are designated 33a and 33b respectively.

Alternatively, as indicated by the dotted lines at 38, portions of the lengths of one of the rims 34 or 35 may be omitted so that two arcuate frames, each having two bolt 36 receiving openings therethrough may be employed on one side of the device so that there is a relieved central portion which gives a greater continuity of interrupted pad extension for roof engagement.

FIGS. 8–10, INCLUSIVE

In these figures are seen the reduction to a minimum size of the device of FIGS. 1–4, inclusive. That is, a rectangular or square pad having, on its upper side, a rectangular or square first frame member circumferentially spaced inwardly thereon, same retained by a pair of parallel, opposed second frame means on the pad lower side bolted to the first frame member, are provided. This is also closely analogous to the construction of FIGS. 5–7, inclusive where the relationship is easily seen through the sequence circle-oval-rectangle-square. The basic concept is that a single space (circular, oval, rectangular or square) is enclosed within the upper outer frame member and secondary frame means on the lower side of the pad are employed, bolted or otherwise attached through the pad to at least portions of the upper outer frame member. With this construction, the upper framed pad for seating, etc. and the lower, partly framed pad for roof engagement are provided.

In FIG. 8, the pad upper surface is designated 40 with side edges 40*a*–40*d*, inclusive. The underside thereof is designated 41. In this case, the square upper frame 42 is circumferentially and peripherally inset from the peripheral edges 40*a*–40*d*, inclusive of pad 40, being secured thereto by round headed bolts 43 having nuts 44 thereon, the bolts and nuts engaging a pair of elongate straight beams 35 and 36 whereby to embed the upper closed frame and lower separate frame members within the pad for the purposes previously described. Once again, the bolts 43 are of lesser length than the normal thickness of pad 40 and the threads thereon limit strike of the members into the pad.

Typical dimensions of pad 40 would be two to three feet on the side with the frame 42 being positioned inwardly three to six inches to the side edges, uniformly. The thickness of the pad would be typically two to four inches or somewhat greater, depeding on the material, its resiliency, etc. Typical density of conventional foam polyurethane mats usable with the subject invention would range from three to eight pounds per cubic foot. Exhaustive information on plastic foams of all types may be found in the Modern Plastic Encyclopedias of current dates. As noted therein, the urethane polymer of cellular foam provides a wide range of typical characteristics, from very soft, flexible foams to strong, tough, rigid foams and from light to density. The density range of foam rubber usable is the same as foam plastic. In case of use of the FIG. 11 modification, the higher density materials are more conveniently usable. Other synthetic foams than urethane are usable.

FIG. 11

Herein is shown a variation of construction which is adaptable to each of the forms seen in this specification, specifically, that is, FIGS. 1–4, inclusive, FIGS. 5–7, inclusive and FIGS. 8–10, inclusive, respectively. The basic concept is to provide, on the down or lower side of the assembly, fixed to the underside of the lower frame members, lengths or strips of foam rubber or foam plastic. The provision of such strips or lengths then avoids any slippage or sliding contact of the metal lower or underside frame members with the roof, thus increasing safety and frictional engagement therewith.

In this figure, there is seen a basic pad 50 of foam rubber. For purposes of description, this pad is assumed to be of a structure like that seen in FIGs. 8–10, inclusive. Pad 50 has upper side 50*a* and lower side 50*b*.

An upper rectangular frame member, like member 42 in FIG. 8, has spaced openings therethrough to receive the shafts of bolts 52. A lower reinforcing member 53, like members 45 and 46 in FIGS. 9 and 10, is provided opposite member 51. In this case, the head of bolt 52 is welded or otherwise fixedly attached to beam member 53. A nut 54 on bolt 52 serves to engage beams 51 and 53 so that both are strongly embedded or impressed into mat 50.

Glued or otherwise fixedly attached to the underside of member 53 is a strip or length of pad 55 of material like that of pad 50. Thus it can be seen that pad elements like portion 55 may be glued or otherwised fixedly attached to the undersides of members like members 23 and 24 of FIGS. 2, 3 and 4 and ring 36 of FIG. 6, as well as beam members 45 and 46 in FIGS. 9 and 10.

In the event that regular bolts through openings in both opposed members are employed, broken strips of the pad material may be glued to the beam members. Alternatively, however, bolt members fixed to the upper sides of the lower beam member are preferred as seen in FIG. 11.

When additional strips of surface adherent pad are placed on the lower beam members, density and lessened resilience may be employed in the pads and strip members, if desired, as there is less slippage potential.

From the foregoing it will be seen that this invention is one well adapted to attain all of the ends and objects hereinabove set forth together with other advantages which are obvious and which are inherent to the apparatus.

it will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown is the accompanying drawings is to be interpreted as illustrative and not in a limiting sense.

I claim:

1. A frictionally engaging, protective seating and working device for use on a rooflike surface comprising, in combination:

a relatively thick, resilient pad of surface adherent, non-skid, foam rubberlike material, an open centered, strong, substantially rigid, integral first frame member positioned on one side of said pad, said first frame member configured to substantially outline the shape of the pad but circumferentially inwardly positioned from the periphery of said pad whereby to be of lesser dimension with respect to said pad periphery, second frame means on the other side of said pad connected to at least portions of said first frame member through said pad, the said connections of such character as to embed the first frame member and second frame means within said pad, whereby:

on the side of the pad carrying the first frame member, portions of the pad protrude both centrally outwardly and circumferentially peripherally outwardly from said first frame member, and on the side of the pad carrying the second frame means, portions of the pad protrude centrally and peripherally outwardly past said second frame means.

2. A device as in claim 1 wherein said pad and said first frame member are circular.

3. A device as in claim 3 as in claim 2 wherein the second frame means, as well as the first frame member, are both circular rings.

4. A device as in claim 1 wherein the pad and first frame member are rectangular in form.

5. A device as in claim 4 wherein the second frame means comprise elongate strips of length and width equivalent to two opposed sides of the first frame member rectangle.

6. A device as in claim 1 wherein the first frame member and second frame means are identical in configuration.

7. A device as in claim 1 wherein the second frame means comprise a pair of substantially identical frame members each matching and attached to a portion of the first frame member through the pad and opposed to one another symmetrically on the opposite side of the pad therefrom.

8. A device as in claim 1 wherein the first frame member and second frame means are removably bolted to one another.

9. A device as in claim 1 wherein the first frame member and second frame means are removably connected to one another in such fashion that the striking or impression of the first frame member and second frame means into the pad in said connection is variably adjustable.

10. A device as in claim 1 wherein the open centered, rigid first frame member has at least one cross beam transversely bisecting the center thereof.

11. A frictionally engaging, protective seating and working device for use on a roof like surface comprising, in combination:

a relatively thick, elongate, substantially rectangular, resilient pad of surface adherent, non-skid, foam rubber-like material, a elongate, ladder-like, substantially open centered, strong, substantially rigid, integral first frame member positioned on one, normally upper side of the pad, said first frame number having a pair of elongate substantially parallel side beams with a plurality of transverse beams interconnecting same as spaced intervals along the length thereof, said first frame member configured so as to substantially outline the shape of the pad, but circumferentially inwardly positioned from the periphery of said pad, whereby to be uniformly of lesser dimension with respect to said pad periphery, second frame means on the other side of said pad connected to the elongate parallel side beams of said first frame member through said pad and comprising elongate substantially parallel side beams of like type and configuration, said pad side receiving said second frame means being normally the lower side thereof, the frame connections of such character as to embed the first frame member and the second frame means within said pad, whereby:

on the upper side pad carrying the first frame member, portions of the pad protrude both centrally upwardly between the side beams and transverse members at a plurality of positions and also circumferentially peripherally outwardly from said frame member, and on the lower pad side carrying the second frame means, a continuous portion of the pad protrudes additional continuous pad portions protruding downwardly, centrally downwardly, inboard between the frame means as well as laterally, outboard of said second frame means.

12. A device as in claim 11 wherein the side beams of the first frame member on the upper side of the pad run the substantial length of the pad and the end transverse member are positioned substantially across the ends of said side beams.

13. A device as in claim 11 wherein the first frame member and second frame means are flat sheetlike material.

14. A device as in claim 13 including corrugations on the upper outer faces of the transverse members of the first frame member.

15. A device as in claim 1 wherein substantial portions of the exposed second frame means have relatively thin, resilient pads of surface adherent, non-skid foam material fixed thereto.

16. A device as in claim 15 wherein the entire exposed portions of said second frame means have said material fixed thereto.

17. A device as in claim 11 wherein substantial portions of the exposed second frame means have relatively thin, resilient pads of surface adherent, non-skid foam material fixed thereto.

18. A device as in claim 17 wherein the entire exposed portions of said second frame means have said material fixed thereto.

* * * * *